US005558143A

United States Patent [19]

Hofacker

[11] Patent Number: 5,558,143

[45] Date of Patent: Sep. 24, 1996

[54] VARIABLE RADIUS BOWING PRESS

[75] Inventor: Chauncey Hofacker, St. Louisville, Ohio

[73] Assignee: The Longaberger Company, Dresden, Ohio

[21] Appl. No.: 368,160

[22] Filed: Jan. 3, 1995

Related U.S. Application Data

[63] Continuation-in-part of Ser. No. 322,915, Oct. 13, 1994.

[51] Int. Cl.[6] ..... B27H 1/00

[52] U.S. Cl. ..... 144/381; 144/256.1; 144/266; 144/348; 144/349; 144/380; 156/196; 156/443

[58] Field of Search ..... 144/256.1, 254, 144/266, 267, 270, 271, 346, 348, 349, 352, 380, 381; 156/196, 323, 443

[56] References Cited

U.S. PATENT DOCUMENTS

| | | | |
|---|---|---|---|
| 2,399,348 | 4/1946 | Hobbs | 144/256.1 |
| 3,063,483 | 11/1962 | Shumacher | 144/266 |
| 4,886,568 | 12/1989 | Strozier | 156/443 |
| 4,967,816 | 11/1990 | Postema | 144/349 |
| 5,199,475 | 4/1993 | Koeder | 156/443 |
| 5,252,160 | 10/1993 | Scanlon et al. | 156/196 |
| 5,293,961 | 3/1994 | Postema | 144/266 |

OTHER PUBLICATIONS

S. Williford, "The Longaberger Story", 1991, p. 88.

*Primary Examiner*—W. Donald Bray
*Attorney, Agent, or Firm*—Porter, Wright, Morris, & Arthur

[57] ABSTRACT

A variable radius bowing press including a mandrel, a mandrel support and a subassembly. The subassembly comprises a housing, a wiper plate capable of pivoting with respect to the mandrel, and an actuator that exerts a force against the wiper plate, causing the wiper plate to pivot. An overbender capable of pivoting with respect to the mandrel may be connected to the wiper plate. An actuating device may be provided that exerts a force against the overbender and causes the over bender to pivot. The apparatus may include two substantially similar subassemblies capable of synchronized operation.

31 Claims, 6 Drawing Sheets

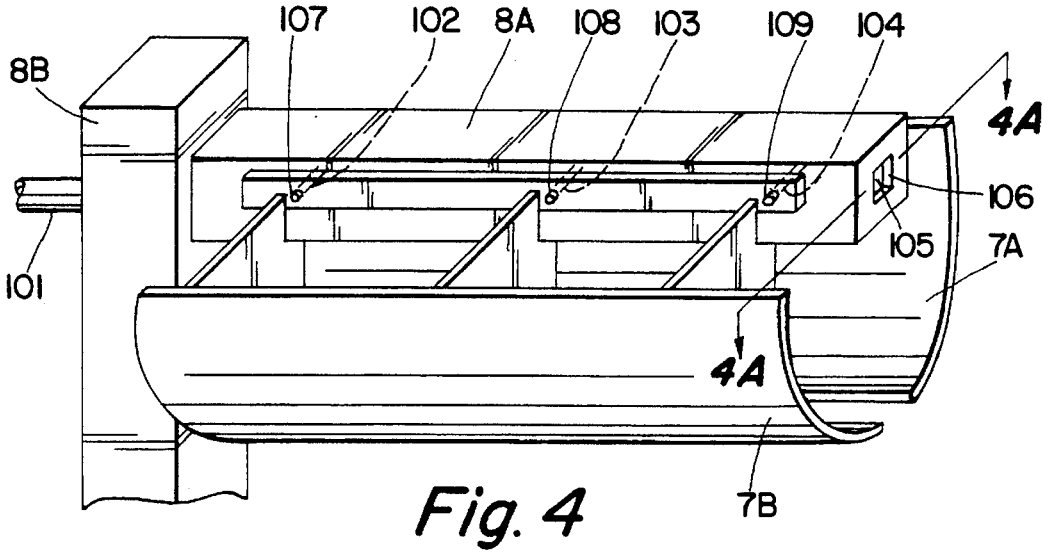
Fig. 4
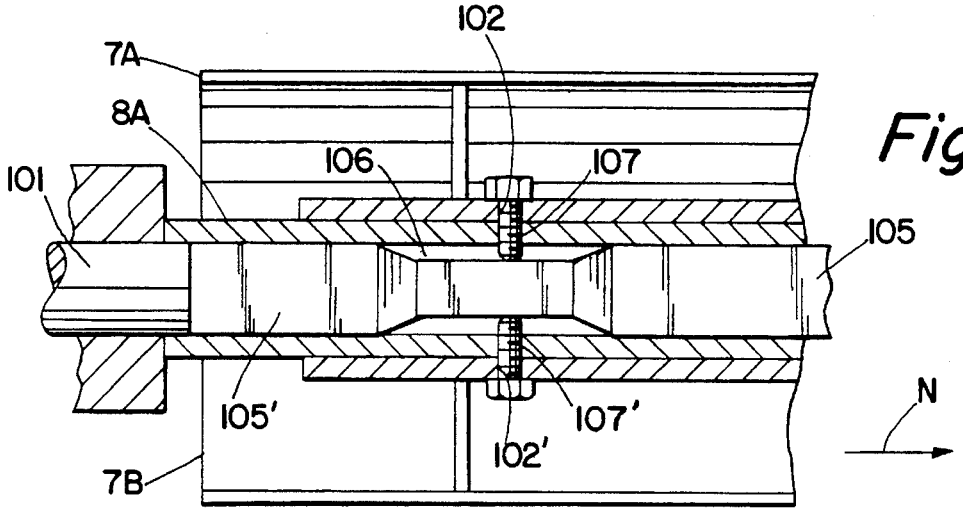
Fig. 4A
Fig. 4B
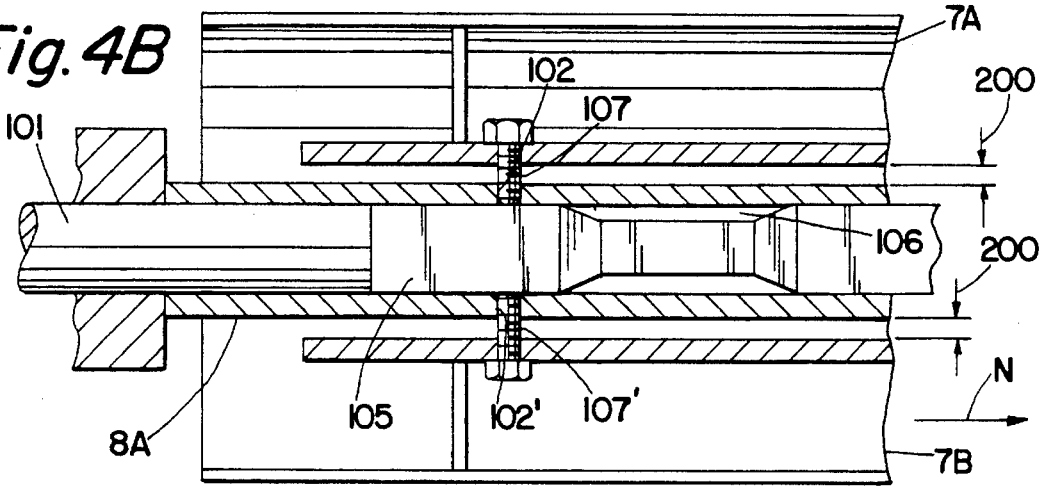

VARIABLE RADIUS BOWING PRESS

RELATED APPLICATION

This is a continuation-in-part application based on parent application Ser. No. 08/322,915, filed Oct. 13, 1994.

BACKGROUND OF THE INVENTION

The present invention is concerned generally with a bowing press, and particularly with a bowing press capable of shaping articles into objects having various radii.

It frequently is desirable to form substantially flat articles into a bowed shape for functional or decorative purposes. When the article to be shaped includes natural fibers, a risk exists that the bowing will damage the fibers, resulting in splintering or other undesirable conditions.

Articles including natural fibers, such as hardwood splints, may be formed into a bowed shape manually. For example, the article may be wetted to increase its pliability, manually bent into conformance with a mold or other shaping device, secured in this conforming position, and allowed to dry.

Manual bowing methods have numerous disadvantages. The manual bending of the article may be physically difficult to accomplish, particularly when this task is to be performed repeatedly. In addition to the physical difficulty of the manual forming and the risk of acute injury associated therewith, repetitive motions, such as those associated with manual bowing methods, may result in chronic injury in some individuals.

Articles bowed by manual methods are susceptible to damage during the bowing process. The force necessary to conform an article to a shaping device may not be applied uniformly across the bowed portion, resulting in breakage of the fibers and splintering. The likelihood of fiber damage increases with the angle desired in the shaped object. The presence of irregularities or flaws, such as knots, in the articles to be bowed also increases the likelihood of fiber damage during bowing. Such fiber damage may adversely affect the strength or appearance of the bowed object, resulting in waste of both raw materials and labor.

Manual bowing methods are also slow and imprecise. Generally, each article must be bowed individually. If the articles are not carefully and fully conformed to a shaping device, the resulting bowed objects may vary from one another in an unacceptable manner.

In addition, manual bowing methods typically require that separate molds be formed for each particular bowed shape desired. Molds made of wood are susceptible to physical damage from the stresses of manual bowing as well as to deterioration over time when these molds are used to bend articles that must be wetted before bowing.

The contents of applicant's parent application, U.S. patent application Ser. No. 08/322,915, is incorporated into the present disclosure by reference.

An object of this invention is to provide an apparatus and method for bowing articles that reduces the physical demands associated with manual bowing methods.

A second object of this invention is to provide an apparatus and method for bowing articles that is less labor intensive than manual bowing methods.

A third object of this invention is to provide an apparatus and method for bowing articles that is faster than manual bowing methods.

A fourth object of this invention is to provide an apparatus and method for bowing articles in which numerous objects may be bowed in a single operation.

A fifth object of this invention is to provide an apparatus and method for bowing articles that results in consistent, uniformly shaped objects.

A sixth object of this invention is to provide an apparatus and method for bowing articles that decreases damage to the articles during bowing, particularly when the articles include natural fibers.

A seventh object of this invention is to provide an apparatus and method for bowing articles in which the articles to be bowed are supported upon a substrate during bending of the articles.

An eighth object of this invention is to provide an apparatus and method in which the force exerted against the article to be bowed during bending is applied more uniformly.

Another object of this invention is to provide an apparatus and method for bowing wooder articles that reduces the scrap rate associated with manual bowing methods.

Yet another object of this invention is to provide an apparatus and method that requires fewer types of molds or shaping devices than conventional bowing methods, that provides more compact shaping supports for bowing an article, and that provides a shaping support for bowing an article that is more resistant to physical damage than conventional shaping supports.

Still another object of this invention is to provide an apparatus and method in which the drying time of bowed objects formed from articles that require wetting before bowing is decreased.

The present invention provides an apparatus and method that allows the bowing of articles having various radii, and that is faster, less labor intensive, and less physically-demanding than manual bowing methods. The apparatus and method of the invention permit the bowing of numerous articles in a single operation and yield consistent, uniformly shaped bowed objects.

The present invention provides an apparatus and method in which pressure is exerted more uniformly upon the article to be bowed, thereby reducing damage to articles during bowing, and particularly to articles that include natural fibers. The present invention also provides an apparatus and method for bowing articles that decreases the scrap rate and permits bowed objects to be formed successfully from articles containing minor flaws or irregularities, such as knots, that would interfere with manual bowing methods.

The apparatus and method of the present invention reduces the number of different shaping supports required to produce bowed objects having a variety of sizes and configurations when compared to manual bowing methods. The present invention also provides shaping supports that are less bulky and easier to store than conventional molds or shaping devices. The present invention also reduces the drying time of bowed objects formed from articles that require wetting before bowing to increase their pliability.

SUMMARY OF THE INVENTION

The foregoing objectives are achieved in a variable radius bowing press comprising a mandrel support, a mandrel which is removably connected to the support, a mandrel cam located within the mandrel support and in communication with the mandrel, and at least one subassembly. The subassembly includes a housing, a wiper plate connected to the housing and capable of pivoting with respect to the mandrel, and an actuator that exerts a force against the wiper plate, causing the wiper plate to pivot.

BRIEF DESCRIPTION OF THE DRAWINGS

FIG. 4 is a perspective view of the mandrel assembly;

FIG. 4A is a cross-sectional top view of a portion of the mandrel cam in its inactive position;

FIG. 4B is a cross-sectional top view of a portion of the mandrel cam in its active position;

DETAILED DESCRIPTION OF THE PREFERRED EMBODIMENT(S)

In its preferred embodiment, the bowing press apparatus of the present invention incorporates two subassemblies that act in concert during a press cycle to form a material into a desired shape. One subassembly may also be remotely used to bend objects into alternative configurations. Each subassembly is substantially identical, with some exceptions noted herein. The following detailed description illustrates one subassembly and its composition, but is equally applicable to both subassemblies. It will be appreciated that minor changes may be made to the apparatus to facilitate molding various materials into different shapes.

Figure 1:
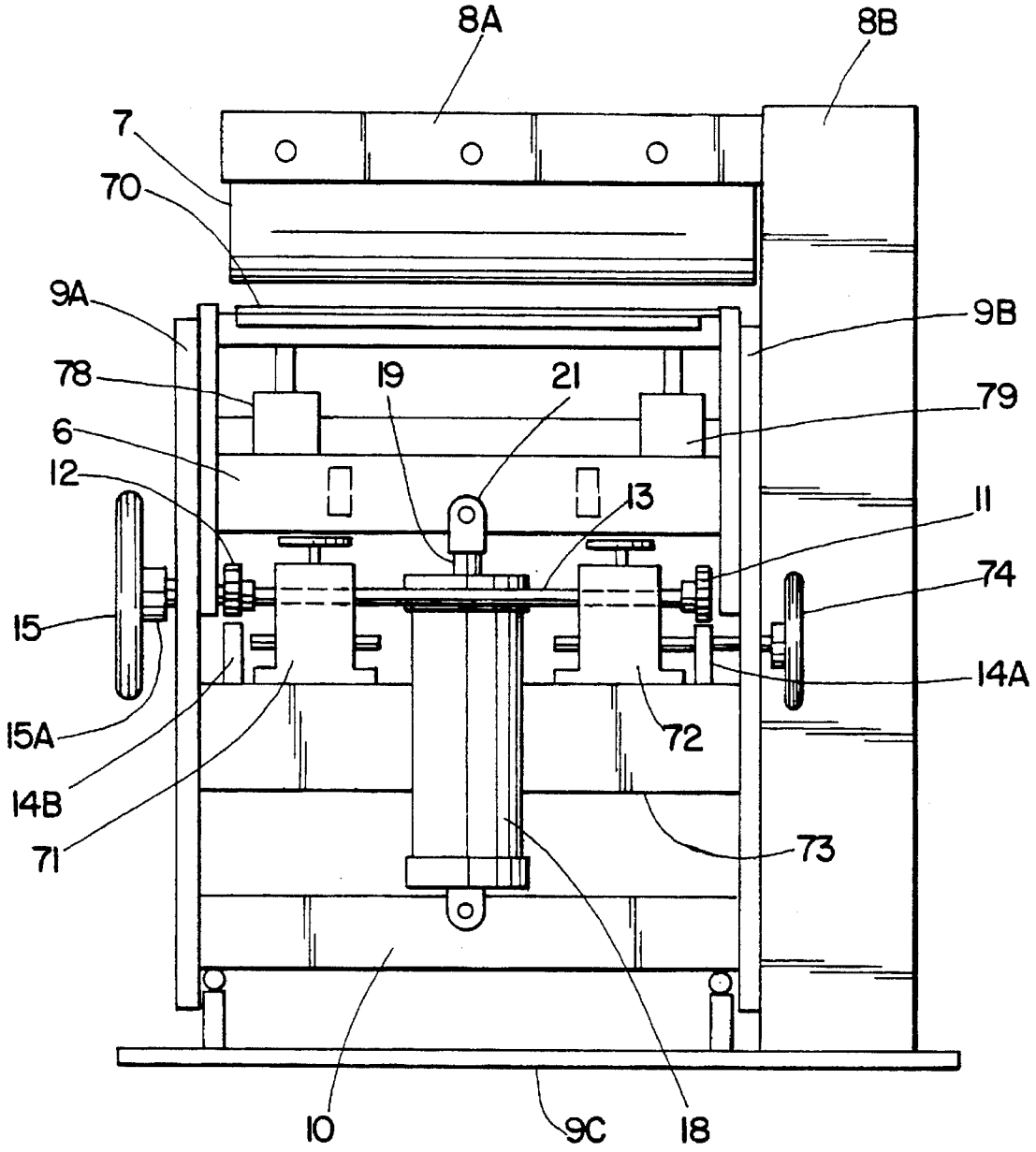
FIG. 1 shows a side view of the variable radius bowing press apparatus.

FIG. 1 shows a side view of subassembly 1 of the apparatus. The press incorporates two subassemblies that act together during a press cycle and rest upon a base frame. The housing includes at least two upwardly extending walls 9A, 9B that rest upon base frame 9C. Mandrel 7 is removably attached to horizontal mandrel support 8A. Mandrel support 8A is connected to vertical mandrel support 8B, which is fixed to base frame 9C. The mandrel's shape and associated radius is dependent on the shape of the article(s) to be bowed. The removability of the mandrel facilitates exchange of various mandrels having different configurations.

The subassembly includes a gear rack assembly defined by gears 11 and 12, which are mounted on gear rack 13 and communicate with side rails 14A and 14B, respectively. Side rails 14A and 14B connect subassembly 1 to subassembly 1' (shown in FIG. 2). In a preferred embodiment, a first end of side rail 14A is fixedly attached to housing 9B of subassembly 1 and a second end of side rail 14A is adjustably attached to housing 9B of subassembly 1'. Likewise, the first end of side rail 14B is fixedly attached to housing 9A of subassembly 1 and the second end of side rail 14B is adjustably attached to housing 9A of subassembly 1'. Gear crank 15 and locking mechanism 15A communicate with the gear rack assembly through housing wall 9A. The gear crank and gear rack assembly work in combination to allow movement of subassembly 1 transversely with respect to subassembly 1' to facilitate the bowing of differently sized articles or to allow for positioning of a mandrel having a different shape. Gear crank 15, when rotated, engages the gear rack assembly causing the subassemblies to move transversely along base frame 9C. A flange wheel assembly, (not shown) located at the bottom of each subassembly communicates with the base frame to provide a low coefficient of friction between these components facilitate movability of each subassembly. Gear crank 15 also locks subassemblies 1 and 1' in position during press operation after a desired spacing of the subassemblies has been achieved.

Cylinder 18 is fixedly connected to the housing by way of bottom cylinder support 10. Bending piston 19 protrudes upwardly from cylinder 18 and is connected to wiper plate support frame 6. The bending piston transmits a force exerted by cylinder 18 against the wiper plate/overbender combination as described hereinafter. Alignment guide 21, attached to bending piston 19, acts to prevent deflection of the force provided by cylinder 18. Accordingly, piston 19 must be composed of a material capable of withstanding and transmitting a force exerted by cylinder 18. By way of example, pneumatic cylinder 18 may have a six (6) inch bore and may be capable of exerting a force approximately equal to 4000 pounds per square inch.

A pressure source is connected to the various cylinders in the apparatus by way of flexible tubing. The placement of this tubing is conducive to both user safety and convenience and provides satisfactory pressure for initiating each cylinder. In the preferred embodiment, all of the cylinders are pneumatic. However, hydraulic cylinders or like devices capable of exerting a sufficient force in a specified direction may be used, in the present configuration, the noise factor was considered in selecting pneumatic cylinders because the device is typically used on a factory floor where loud noise is commonplace; thus, any reduction in noise without loss of performance is desirable.

A pinch plate platform assembly located between subassemblies 1 and 1' (shown in FIG. 2) includes pinch plate platform 70, adjustable screw jacks 71 and 72, screw jack mounting plate 73, platform mounting bracket (shown in FIG. 2), and air actuators 78 and 79. The air actuators communicate with the pinch plate platform and, upon press activation, force the platform linearly upward toward mandrel 7. Jack adjustment 74 varies the height of the pinch plate platform 70 in its inactive (or lowermost) position relative to mandrel 7 by way of a mounting bracket (not shown). The desired platform height is dependent on the radius of the mandrel and the size of the articles to be bowed. Accordingly, as the radius of the mandrel or the size of the articles increases, the screw jacks are retracted, lowering the pinch plate platform; as the radius of the mandrel or the size of the articles decreases, the screw jacks are lifted, raising the pinch plate platform.

Figure 2:
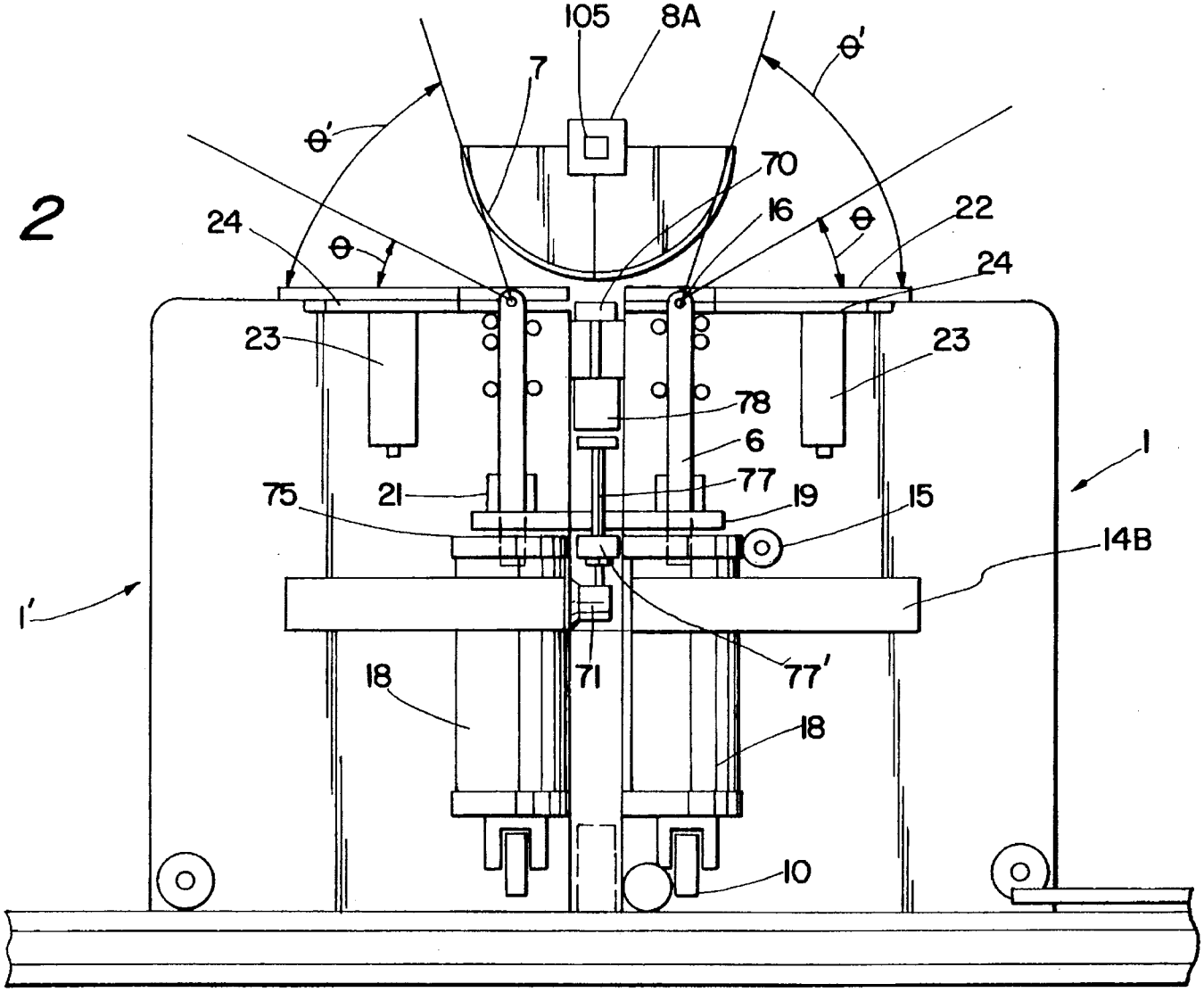
FIG. 2 is a front view of the variable radius bowing press apparatus illustrating two subassemblies.
Figure 3A:
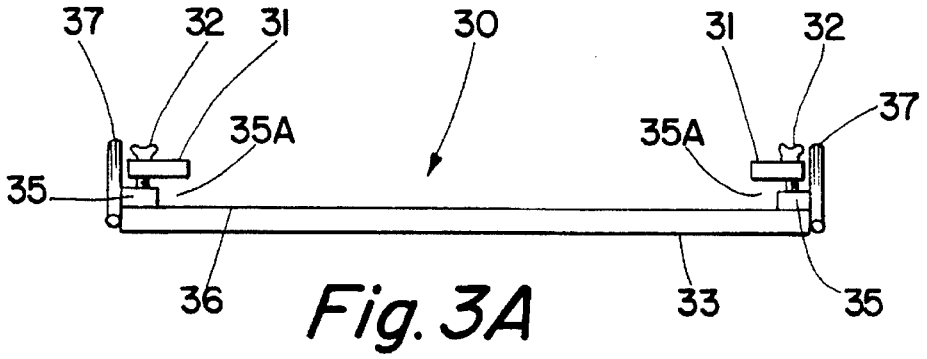
FIGS. 3A is a side view of a tray in the present invention.
Figure 3B:
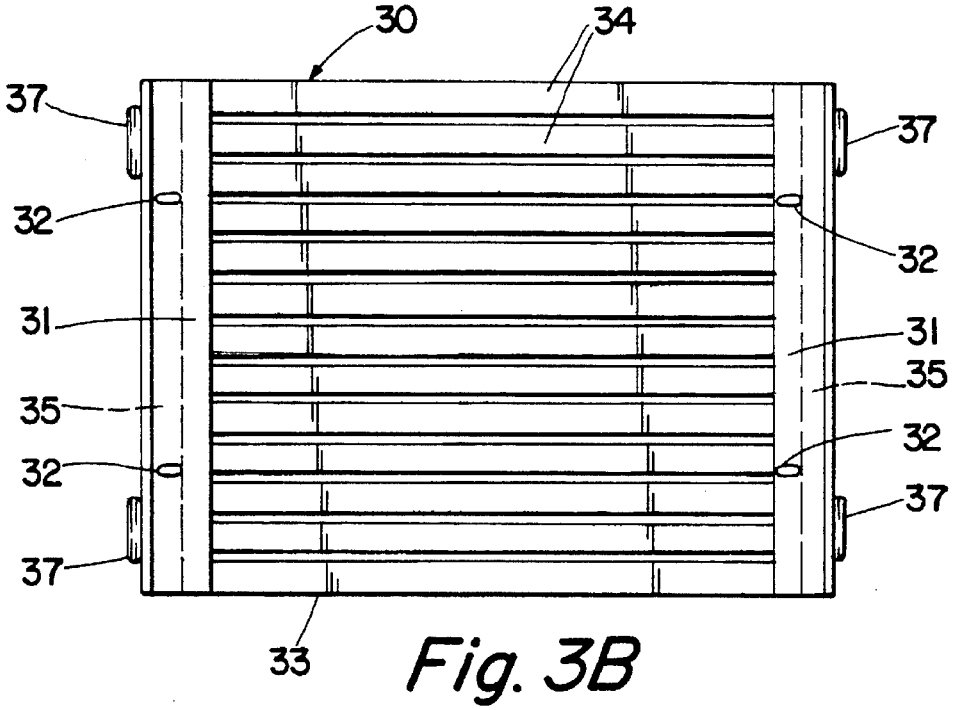
FIG. 3B is a top view of the tray in the present invention.
Figure 3C:
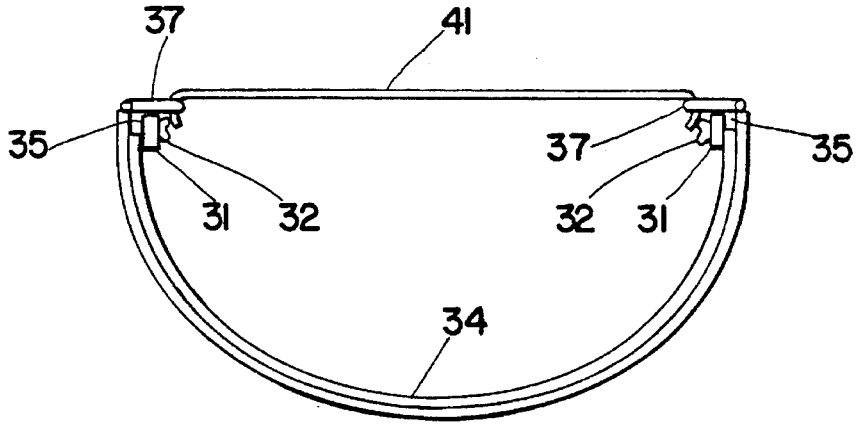
FIG. 3C is a side view of a tray, its contents, and tray bracket after a press cycle is complete.

FIG. 2 illustrates a front view of the variable radius bowing press with the outer housing plate 9A removed. Wiper plate 16 and overbender 22 are both rigid members which have an inactive and an active station. In the inactive station, the wiper plate and overbender define a substantially horizontal plane, and the wiper plate and mandrel 7 define a space therebetween for insertion of a forming tray (as shown in FIGS. 3A, 3B and 3C). One end of overbender 22 is positioned substantially adjacent to the outer longitudinal side of wiper plate 16. The wiper plate, which is pivotally attached at its other end to wiper plate support frame 6, is positioned partially beneath and extends longitudinally and substantially parallel to mandrel 7. The wiper plate has a smooth durable surface which provides low resistance to sliding movement of a tray.

Screw jack 71 and platform mounting bracket 77 are adjusted proportionately to the radius of the mandrel and size of the tray. As the press is activated by a user, air actuator 78 (together with air actuator 79, not shown in FIG. 2) forces pinch plate platform 70 linearly upward toward mandrel 7. Wiper plate 16 and overbender 22 are initially displaced, as a unit, linearly upward toward mandrel 7 by way of cylinder 18, bending piston 19 and wiper plate support frame 6. As the tray overlaying the wiper plate and overbender comes into contact with the mandrel, the wiper plate ceases to move linearly and is displaced pivotally by way of cylinder 18, bending piston 19 and wiper plate support frame 6. The wiper plate and overbender pivot radially along angle Θ relative to the press's horizontal plane. Angle Θ may vary depending on the curvature desired in the material to be bowed. When the wiper plate reaches angle Θ, its movement ceases and overbender 22 continues pivotally and radially along angle Θ' by way of an additional cylinder 23. This cylinder is connected to a "U" shaped bracket 24 containing a trunnion plate which maintains a constant angle relative to overbender 22 and allows the cylinder to move with wiper plate 16 to angle Θ, where cylinder 23 is activated. The "U" shaped bracket imparts the cylinder's force directly onto overbender 22, thereby minimizing deflection. The overbender continues its radial movement to a desired angle Θ'. Thus, the forces exerted against the tray induce it to bend around the axial radius of mandrel 7 which results in the desired shape of a tray's contents.

By way of example, wood splints may be placed in a tray to form round basket handles 34 of a shape illustrated in FIG. 3C. The tray containing a plurality of wood splints is placed in the press and rests upon wiper plate 16 and overbender 22. Upon activation, cylinder 18 applies a force which displaces the tray linearly upward toward mandrel 7 until the wood splints come into contact with the mandrel. Air actuators 78 and 79 force pinch plate platform 70 upwardly which assists in the linear upward movement of the tray's and the securing of the tray contents against the mandrel. Wiper plate 16 and overbender 22 are displaced by cylinder 18, rotatably along angle Θ. To achieve the handle shape in FIG. 3C, Θ is within the range of approximately 35 to 45 degrees. Upon reaching angle Θ, cylinder 23 is actuated, thereby displacing overbender 22 along angle Θ'. For the handle shape in FIG. 3C, Θ' is within the range of approximately 80 to 90 degrees. These angle measurements are dependent on the size of the tray, the thickness of the articles to be bowed, and the radius of the mandrel. It should be noted that mandrels having different radii can be used, thereby allowing the tray's contents to be pressed in a particular configuration. Various cylinders may be used which are capable of imparting forces that bend more rigid material than wood splints. The space between each subassembly may also be changed to achieve a desired configuration in the article to be bowed.

Returning to FIG. 2, as wiper plate 16 reaches angle Θ, and as overbender 22 reaches angle Θ downward forces are exerted against a tray at the points where the tray rests on pinch plate platform 70. The pinch plate opposes the downward force exerted against the tray during bending, thereby assisting in preventing excessive or undesirable crowning of the center portion of the tray's contents during a press cycle. The thickness of the inner surface of the mandrel may be increased at predetermined locations to provide greater resistance to the force exerted against the tray, which also may assist in preventing crowning. The operation described above is performed substantially simultaneously with respect to subassembly 1'.

Synchronizer bars 75 are attached at one end to wiper plate support frame 6 and communicate perpendicularly with lower member 77' of pinch plate platform mounting bracket 77. The air actuators used in the present embodiment retract by operation of gravity. Thus, as a press cycle is completed and the pinch plate platform retracts to its inactive state, the synchronizer bars restrict the downward movement of the platform as it comes into contact with lower member 77' of platform mounting bracket 77. As discussed earlier, when a mandrel having a larger radius is employed, the pinch plate platform as well as the wiper plate/overbender combination must be lowered with respect to the mandrel. The synchronizer bars facilitate the retraction of these components as a unit. As adjustable screw jacks 71 and 72 are retracted, lower platform mounting bracket member 77' and synchronizer bar 75 are lowered, thereby lowering wiper plate support 6. Accordingly, the synchronizer bars act as a wedge to limit the downward movement of the pinch plate platform as well as the wiper plate/overbender combination.

FIG. 3A is a side view of forming tray 30 which includes a tray body 33 having an upper surface 36. The tray body is formed from a flexible but durable composition, such as stainless steel. Preferably, the tray is resistant to liquids and is capable of withstanding temperatures at least as high as 160° F. FIG. 3B is a top view of a tray 30 having a substantially rectangular shape, but other configurations may also be used. An eye 37 or other fastener-receiving device may be provided on opposing sides of tray 30 for use in securing the ends of the bowed tray to one another. Preferably, the eyes 37 project transversely from the tray surface.

Retainers 31 are arranged parallel to left and right edges of the tray body 33 and are maintained at a desired distance above the tray body 33 by spacers 35. The retainers 31 overhang the spacers 35.

The height of the spacers 35 corresponds to the thickness of the articles to be bowed so that the ends of the article may be inserted into the slots 35A defined by the retainers 31 and the tray body 33. Although a particular spacer height may accommodate articles that vary slightly in thickness, a differently-sized spacer may be required to accommodate large variations in thickness.

A retainer 31 may be movably connected to a spacer 35 by a fastener 32. Preferably, the fastener 32 is inserted through a slot or bore (not shown in the drawings) provided in the retainer 31 and extends into the spacer 35 such that the retainer 31 is capable of moving from a first position to a second position relative to the tray body 33. When a slot is arranged perpendicular to or diagonally with respect to the retainer's longitudinal dimension, the retainer is capable of sliding from an inward position suitable for securing articles within the tray to an outward position suitable for releasing the objects from the tray. Alternatively, the retainer may slide vertically along the shaft of fastener 32 from a lower position suitable for securing articles within the tray to an upper position suitable for releasing articles from the tray. The retainer may also be hingedly connected to the tray having an active and an inactive position. In its active position, the retainer engages the tray's contents; in its inactive position, the retainer is displaced radially away from the tray's contents to allow removal of the contents Upon completion of a press cycle, the tray 30 and its contents 34 are bent about the mandrel as illustrated in FIG.

3C. The tray bracket 41 is fastened between the eyes 37 to secure the opposing ends of the tray 30 to one another while the tray is in the bent position. After the tray bracket 41 is inserted, the tray 30 may be removed from the press. However, tension between the tray, the mandrel, the pinch plate platform and the overbender/wiper plate assembly prevents removal of the tray. Thus, a mechanism must be employed to release this tension before the tray can be removed.

FIG. 4 is a perspective view of mandrel 7, horizontal mandrel support 8A and vertical mandrel support 8B. Although the mandrel is shown in two sections, 7A and 7B, which are removably attached to horizontal mandrel support 8A by way of mandrel bores 102, 103 and 104, a one-piece mandrel may also be employed. Mandrel cam 105 is located within horizontal mandrel support lumen 106 and extends substantially the longitudinal dimension of horizontal mandrel support 8A. The diameter of cam 105 is sufficiently less than the diameter of lumen 106 to allow for controlled movement therebetween. Cylinder 101 is attached to the horizontal mandrel support and is capable of exerting a force against mandrel cam 105 to facilitate movement of the mandrel cam within the mandrel cavity.

The mandrel cam has an inactive and an active station as illustrated in FIGS. 4A and 4B respectively. FIGS. 4A and 4B are cut-away cross-sectional views of the mandrel and related members. Mandrel cam 105 communicates with pins 107, 108 and 109 located in bores 102, 103 and 104, respectively. Mandrel cam 105 communicates with pins 107, 108 and 109, which may be received within bores 102, 103 and 104, respectively. Pin 107 communicates with cam 105 by way of bore 102. In its inactive station, as shown in FIG. 4A, pins 107 and 107' communicate with the indented portion of cam 105, which allows mandrels 7A and 7B to be in substantially flush contact with mandrel support 8A. The cam has an indented shape at each corresponding pin location. Upon activation of a press cycle, cylinder 101 drives mandrel cam 105 into its active station whereby the cam is displaced (in direction "N") within mandrel lumen 106. This forces pin 107 (and associated pins 108, 109) to ride the inclined portion of cam 105 and protrude transversely relative to mandrel support 8A. The protrusion of the pins displaces mandrel 7A and 7B transversely from horizontal mandrel support 8A, as illustrated in FIG. 4B (displacement distance referenced by 200). The mandrel cam remains in its active station while the press cycle continues and a tray is bowed around the axial radius of the mandrel. Upon completion of the cycle, cylinder 101 is deactivated and the mandrel cam and pins return to their inactive stations. This relieves the tension on the tray and facilitates easy tray removal.

The apparatus of the present invention may be used as described below. This description assumes that more than one article will be bowed in a single operation. However, the apparatus and method of the present invention may also be used to bow a single article, provided the width of the article is slightly less than the width of the forming tray and the length of the article is no more than slightly longer than the length of the forming tray.

Before loading the articles to be bowed into a forming tray, the articles may be wetted to increase their pliability. The wetting may be accomplished by immersing the articles, such as wood splints, in water or another suitable softening medium. The immersion time and water temperature may be adjusted depending on such factors as the type, condition and thickness of the article to be bowed, the bowing angle desired, and whether discoloration of the resulting bowed object is undesirable in a particular application. Preferably, wetted objects will be loaded into the forming trays as soon as possible after they are removed from the water. If the articles to be bowed are sufficiently pliable, however, wetting may not be required.

The splints or other articles to be bowed may be loaded onto the forming tray 30 in substantially abutting parallel relationship, as shown in FIG. 3B. The opposing ends of the articles are inserted into the slots 35A defined by the retainers 31 and the tray body 33. When a desired number of objects has been loaded into the tray 30, the tray may be inserted into the bowing press.

Figure 5:
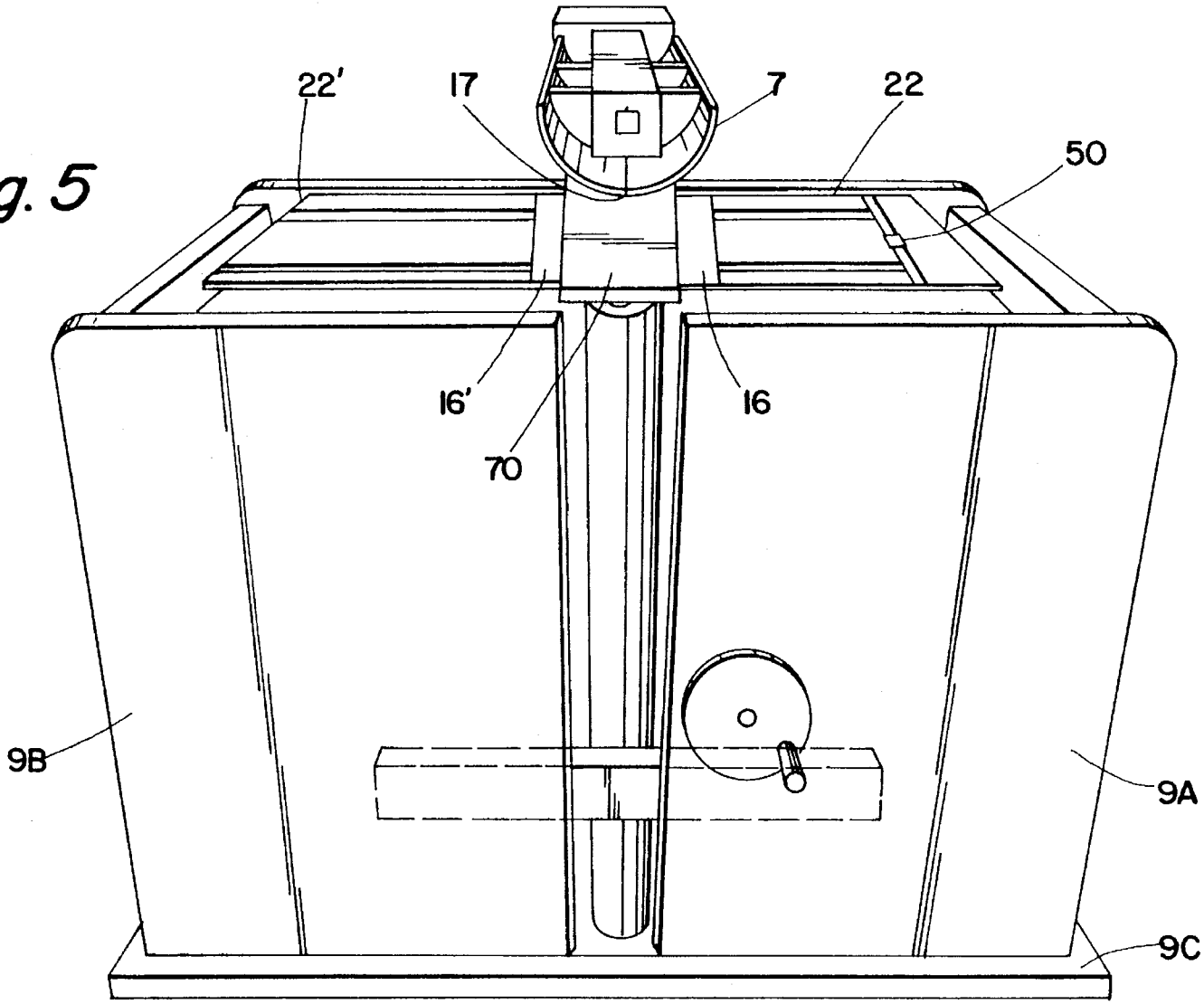
FIG. 5 is a perspective view of the variable radius bowing press of the present invention in its inactive station.

FIG. 5 is a perspective view of the press in its inactive station. The loaded tray is placed on the press in space 17, whereby mandrel 7 acts as a fulcrum point around which the tray is bent. To facilitate proper tray placement, tray stopper 50 is connected to the upper surface of an overbender 22 at a specified distance from the pinch plate platform 70. A tray end abuts the tray stopper, assuring a user that the tray is positioned correctly. As different sized trays are used, the tray stopper may be adjusted accordingly on overbender 22. A rear tray stopper may also be provided, for example, on wiper plate 16, 16' or overbender 22, 22', to guide placement of the rear of a tray.

Figure 6:
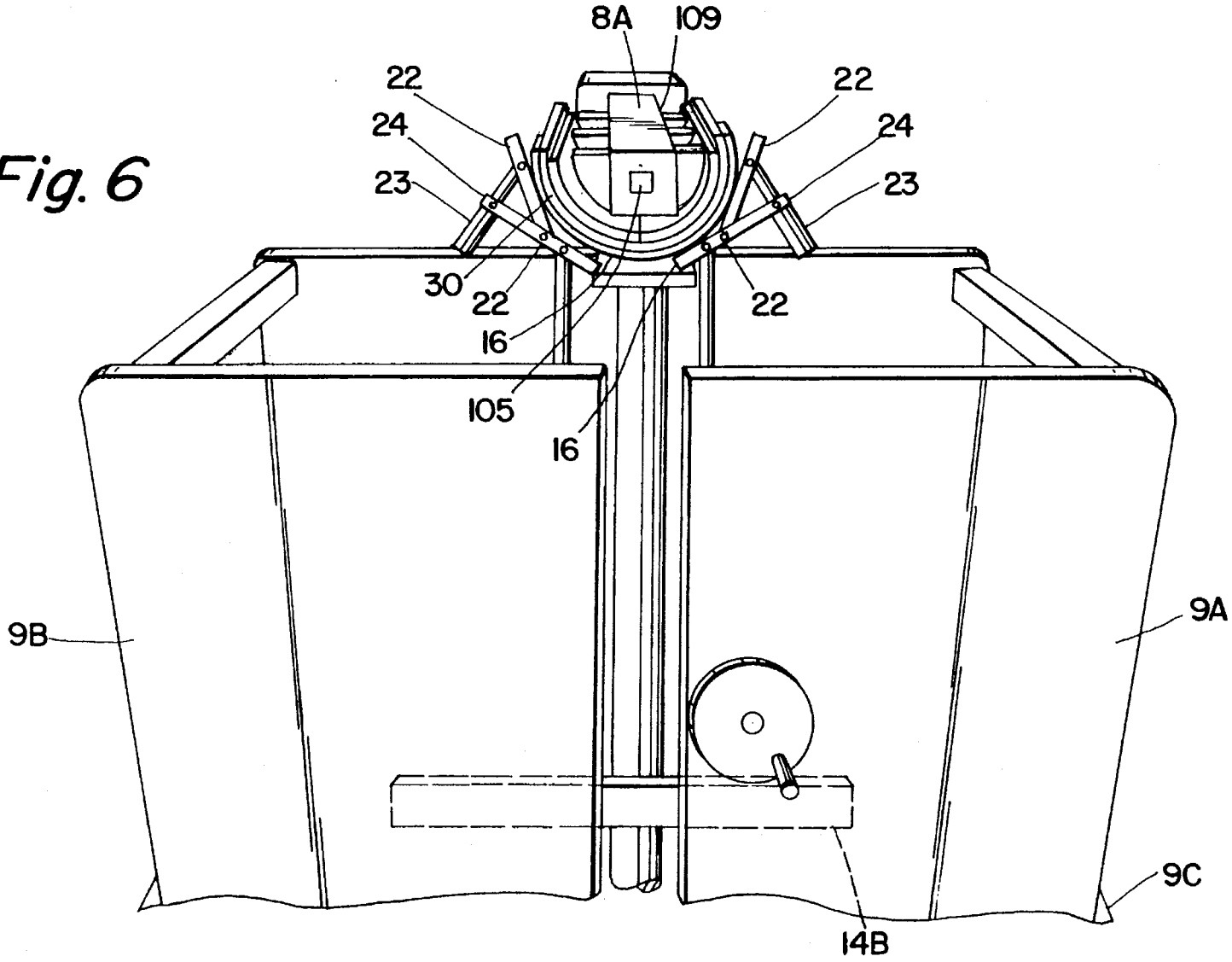
FIG. 6 is a perspective view of the variable radius bowing press of the present invention in its active station.

Upon press activation, as illustrated in FIG. 6, pinch plate platform 70 and wiper plate support frame 6 force tray 30 linearly upward toward mandrel 7A, 7B. Mandrel cam 105 is initiated into its active station whereby pins 107, 108, and 109 are displaced transversely outward with respect to mandrel support 8A. The pins force mandrel 7A and 7B to expand outward from the horizontal mandrel support. Wiper plate 16 bends tray 30 along angle Θ and overbender 22 continues radially along angle Θ' by way of cylinder 23 and "U" shaped bracket 24. Upon reaching the desired bowing angles, brackets 41 are placed in eyes 37 of tray 30 to retain the tray in its bent configuration (as shown in FIG. 3C). After the bending of the tray and placement of the brackets is complete, mandrel cam 105 returns to its inactive station, releasing the tension exerted on tray 30. Likewise, wiper plate 16 and overbender 22 return to their respective inactive stations and the bowed tray is removed from the press.

The tray and its contents are set aside to rest and, if the splints have been wetted, to dry. If the splints have been wetted, the bowed tray may be inverted during drying so that the tray edges rest on the supporting surface to assist in draining water away from the tray contents. The optimum time and temperature for curing and drying may vary with the composition and thickness of the bowed objects. If the bowed objects are not permitted sufficient curing or drying time after bowing, the objects will not retain the desired shape after they are removed from the forming tray, but instead will tend to open up into a less bowed shape. This tendency may be obvious immediately after the objects are released from the tray. If the bowed objects remain within the trays for an extended period after the bowing process, the risk of damage to the bowed objects during removal from the tray increases.

Returning to FIG. 3C, the bowed objects may be released from the tray as follows. Tray bracket 41 is removed from the tray eyes 37 shown in FIG. 3C. The fasteners 32 that extend through the retainers 31 and into the spacers 35 may be loosened along one edge of the tray 30 as shown in FIG. 3A. When these fasteners 32 are loosened, the retainer 31 may be moved away from the tray body 33, freeing an end of the bowed objects from the slot 35A between the retainer 31 and the tray surface 33. The other end of the bowed objects then may be moved out of the slot 35A on the other edge of tray 30.

By way of example, the apparatus and method of the present invention may be used to bow hardwood splints to form basket handles. Thin maple splints in the range of approximately 3/16th-inch thick are immersed for a minimum of about 10 to 15 minutes in water, preferably maintained at a temperature of about 140 to about 160° F. Immersion for periods of more than about 25 minutes is likely to result in discoloration of the splints.

FIG. 3C is an end view of a bowed tray of splints 34 that have been formed into a configuration desirable for round basket handles. Trays holding bowed handles formed from wetted maple splints typically are dried in an area having adequate air circulation and a temperature of up to about 160° F. for approximately 7 hours. When the resulting bowed object remains in a forming tray for more than about 12–14 hours, the risk of splint cracking increases. Although a specific embodiment of the invention has been described herein in detail, it is understood that variations may be made thereto by those skilled in the art without departing from the spirit of the invention or the scope of the appended claims.

What is claimed is:

1. A variable radius bowing press, comprising:

a mandrel support;

a mandrel removably connected to said mandrel support; and a subassembly including a housing, a substantially planar wiper plate connected to said housing and capable of pivoting with respect to said mandrel, and an actuator capable of exerting a force against said wiper plate to cause said wiper plate to pivot.

2. The apparatus of claim 1, wherein said subassembly includes an overbender connected to said wiper plate and capable of pivoting with respect to said mandrel and said wiper plate.

3. The apparatus of claim 2, wherein said subassembly includes an actuating device capable of exerting a force against said overbender to cause said overbender to pivot with respect to said mandrel.

4. The apparatus of claim 2, further including a tray stopper adjustably attached to said overbender.

5. The apparatus of claim 1, wherein said subassembly is capable of movement in relation to said mandrel.

6. The apparatus of claim 1, further including a mandrel cam located within said mandrel support and communicating with said mandrel, said cam capable of movement within said mandrel support to facilitate transverse displacement of said mandrel with respect to said mandrel support.

7. The apparatus of claim 1, wherein said actuator is a pneumatic cylinder.

8. The apparatus of claim 2, further including a wiper plate support frame and an activator, said frame having a first end connected to said wiper plate and a second end communicating with said activator.

9. The apparatus of claim 1, further including a pinch plate platform communicating with said housing and a piston device for exerting a force against said platform to cause said platform to move linearly with respect to said mandrel.

10. The apparatus of claim 1, further including a base frame located underneath said subassembly and supporting said housing, said mandrel support including a vertical member having a first and second end and a horizontal arm, said first end of said vertical member connected to said horizontal arm and said second end attached to said base frame.

11. The apparatus of claim 2, further including a tray containing an article to be bowed, said tray removably communicating with said wiper plate and said overbender.

12. A variable radius bowing press comprising:

a mandrel support;

a mandrel removably connected to said mandrel support; and a housing including at least two wiper plates connected to said housing, each of said wiper plates capable of pivoting with respect to said mandrel, and an actuator for exerting a force against each of said wiper plates to cause said wiper plates to pivot.

13. The apparatus of claim 12, wherein said housing includes two overbenders connected to said housing, each of said overbenders capable of pivoting with respect to said mandrel, and an actuating device for exerting a force against said overbenders to cause said overbenders to pivot.

14. The apparatus of claim 12, further including two wiper plate support frames, each of said flames having a first end connected to one of said wiper plates and a second end connected to said actuator.

15. The apparatus of claim 12, further including a mandrel cam located within said mandrel support and communicating with said mandrel, said cam capable of movement within said mandrel support to facilitate transverse displacement of said mandrel with respect to said mandrel support.

16. The apparatus of claim 15, including a cam actuator communicating with said mandrel cam, said actuator capable of exerting a force against said cam.

17. The apparatus of claim 12, further including a pinch plate platform communicating with said housing and a piston device for exerting a force against said platform causing said platform to move linearly with respect to said mandrel.

18. The apparatus of claim 12, further including a base frame located underneath said housing.

19. A variable radius bowing press, comprising:

a mandrel support;

a mandrel removably connected to said mandrel support;

a mandrel cam located within said mandrel support and capable of movement within said mandrel support;

a first subassembly including a wiper plate capable of pivoting with respect to said mandrel, an actuator, a wiper plate support frame having a first end connected to said wiper plate and a second end connected to said actuator, said actuator capable of exerting a force against said wiper plate to cause said wiper plate to pivot; and a second subassembly including a wiper plate capable of pivoting with respect to said mandrel, an actuator, a wiper plate support frame having a first end connected to said wiper plate and a second end connected to said actuator, said actuator capable of exerting a force against said wiper plate to cause said wiper plate to pivot, said second subassembly capable of adjustable movement in relation to said first subassembly.

20. The apparatus of claim 19, wherein said first subassembly includes an overbender connected to said wiper plate, and an actuator capable of exerting a force against said overbender to cause said overbender to pivot with respect to said mandrel.

21. The apparatus of claim 19, wherein said second subassembly includes an overbender connected to said wiper plate, and an actuator capable of exerting a force against said overbender to cause said overbender to pivot with respect to said mandrel.

22. The apparatus of claim 19, wherein said first subassembly wiper plate and said second subassembly wiper plate pivot with respect to said mandrel in a synchronized fashion.

23. The apparatus of claim 19, further including a pinch plate platform located between said first and second subassemblies and an actuator capable of exerting a force against said platform to cause said platform to move linearly with respect to said mandrel.

24. A method for bowing a substrate, comprising the steps of:

placing a substrate on a support;

placing the supported substrate between a mandrel and a substantially planar wiper plate;

rotating the wiper plate in relation to the mandrel to conform the supported substrate to a portion of the mandrel; and removing the supported substrate from engagement with the mandrel.

25. The method of claim 24, further including the step of: rotating an overbender in relation to said mandrel to conform said substrate to a portion of said mandrel.

26. The method of claim 25, wherein the step of rotating an overbender in relation to said mandrel to conform said substrate to a portion of said mandrel further comprises the steps of:

rotating said overbender through a first predetermined angle in cooperation with the rotation of said wiper plate about said mandrel; and further rotating said overbender through a second predetermined angle independent of the rotation of said wiper plate about said mandrel.

27. The method of claim 24, further including the step of: treating said substrate to provide increased pliability of said substrate.

28. The method of claim 24 further including the step of: causing a pinch plate platform to move linearly toward said mandrel.

29. The method of claim 24, further including the step of: causing said wiper plate to move linearly toward said mandrel.

30. A bowing press apparatus, comprising:

a first and second housing, said second housing capable of movement with respect to said first housing;

a mandrel support substantially centered with respect to said first and said second housings;

a mandrel removably connected to said mandrel support;

a mandrel cam located within said mandrel support;

a cam actuator capable of exerting a force against said mandrel cam;

a first wiper plate assembly connected to said first housing and capable of pivoting with respect to said mandrel;

a first overbender connected to said wiper plate assembly and capable of pivoting with respect to said mandrel;

a second wiper plate assembly connected to said second housing and capable of pivoting with respect to said mandrel;

a second overbender connected to said second wiper plate assembly and capable of pivoting with respect to said mandrel; a first actuator capable of exerting a force against said first wiper plate assembly to cause said wiper plate assembly to pivot;

a second actuator capable of exerting a force against said second wiper plate assembly to cause said wiper plate assembly to pivot;

a pinch plate platform assembly located between said first and second housings, said assembly including a pinch plate platform, a pinch plate support frame connected to said platform and an actuator, said actuator capable of exerting a force against said support frame to cause said platform to move linearly toward said mandrel;

a tray containing articles to be bowed, said tray removably communicating with said first and second wiper plates and said first and second overbenders; and a tray stopper adjustably attached to one of said overbenders and communicating with said tray.

31. The apparatus of claim 30, further including a synchronizer bar communicating with said pinch plate support frame, said bar limiting the corresponding movement of said support frame.

* * * * *